US011795596B2

(12) United States Patent
Masters

(10) Patent No.: US 11,795,596 B2
(45) Date of Patent: Oct. 24, 2023

(54) METHOD OF HEATING THE CLOTHES LOAD IN A TUMBLING COMBINATION WASHER/DRYER

(71) Applicant: Whirlpool Corporation, Benton Harbor, MI (US)

(72) Inventor: Roy E. Masters, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 78 days.

(21) Appl. No.: 17/509,310

(22) Filed: Oct. 25, 2021

(65) Prior Publication Data

US 2022/0145509 A1 May 12, 2022

Related U.S. Application Data

(63) Continuation of application No. 17/091,173, filed on Nov. 6, 2020.

(51) Int. Cl.

| | |
|---|---|
| ***D06F 25/00*** | (2006.01) |
| ***D06F 39/04*** | (2006.01) |
| ***D06F 58/02*** | (2006.01) |
| ***D06F 58/26*** | (2006.01) |
| ***D06F 37/04*** | (2006.01) |
| ***D06F 37/26*** | (2006.01) |

(52) U.S. Cl.

CPC ..... *D06F 25/00* (2013.01); *D06F 39/04* (2013.01); *D06F 58/02* (2013.01); *D06F 58/26* (2013.01); *D06F 37/04* (2013.01); *D06F 37/26* (2013.01)

(58) Field of Classification Search

CPC ..... D06F 25/00; D06F 37/26; D06F 39/04; D06F 58/02; D06F 58/26

See application file for complete search history.

(56) References Cited

U.S. PATENT DOCUMENTS

| | | | | |
|---|---|---|---|---|
| 7,992,322 | B2 | 8/2011 | Kim | |
| 10,590,583 | B2 | 3/2020 | Kitayama | |
| 10,590,588 | B2 | 3/2020 | Kim et al. | |
| 2003/0089138 | A1 | 5/2003 | Kawamura et al. | |
| 2005/0229646 | A1* | 10/2005 | Byun | D06F 25/00 68/19.2 |
| 2005/0229650 | A1 | 10/2005 | Kim et al. | |
| 2006/0225468 | A1* | 10/2006 | Hong | D06F 25/00 68/19.2 |

(Continued)

FOREIGN PATENT DOCUMENTS

| | | | |
|---|---|---|---|
| CN | 104018318 | A | 9/2014 |
| EP | 0829569 | A2 | 3/1998 |

(Continued)

OTHER PUBLICATIONS

European Search Report for EP21204858, dated Mar. 21, 2022 (85 Pages).

(Continued)

*Primary Examiner* — Joseph L. Perrin

(74) *Attorney, Agent, or Firm* — Harness, Dickey & Pierce, PLC

(57) ABSTRACT

A combination washer/dryer machine has a cabinet with a tub and drum positioned in the cabinet. The drum is rotatably positioned in the tub. A heater is secured to the tub. The heater includes a duct to provide heated air from the heater. The duct is coupled with the tub to supply heated air to the drum.

20 Claims, 4 Drawing Sheets

(56) References Cited

U.S. PATENT DOCUMENTS

| | | | | |
|---|---|---|---|---|
| 2008/0244922 | A1* | 10/2008 | Kim | D06F 58/26 34/235 |
| 2012/0186305 | A1 | 7/2012 | Taniguchi et al. | |
| 2012/0260520 | A1 | 10/2012 | Hong et al. | |
| 2013/0198970 | A1* | 8/2013 | Doh | D06F 25/00 8/137 |
| 2015/0191863 | A1* | 7/2015 | Kim | D06F 58/20 34/493 |
| 2016/0168777 | A1* | 6/2016 | Bison | D06F 58/206 62/238.7 |
| 2019/0338455 | A1* | 11/2019 | Garnek | D06F 58/24 |
| 2020/0190726 | A1* | 6/2020 | Jang | D06F 39/04 |

FOREIGN PATENT DOCUMENTS

| | | | |
|---|---|---|---|
| EP | 2206821 | A1 | 7/2010 |
| EP | 2725131 | A1 | 4/2014 |
| EP | 2894251 | A2 | 7/2015 |
| EP | 3564429 | A1 | 11/2019 |
| JP | 3920314 | B2 | 5/2007 |
| JP | 4952727 | B2 | 6/2012 |
| WO | WO-89-02003 | A1 | 3/1989 |
| WO | WO-2004-104288 | A1 | 12/2004 |
| WO | WO-2014-181493 | A1 | 11/2014 |
| WO | WO-2018-123845 | A1 | 7/2018 |

OTHER PUBLICATIONS

Final Office Action from the United States Patent and Trademark Office, dated Feb. 21, 2023, during the prosecution of U.S. Appl. No. 17/091,173 (12 pages).

* cited by examiner

METHOD OF HEATING THE CLOTHES LOAD IN A TUMBLING COMBINATION WASHER/DRYER

CROSS-REFERENCE TO RELATED APPLICATION

This application is a continuation of U.S. patent application Ser. No. 17/091,173, filed on Nov. 6, 2020. The entire disclosure of the above application is incorporated herein by reference.

FIELD

The present disclosure relates to a combination washer/dryer machine and, more particularly, to a heating circuit in the combination washer/dryer machine.

BACKGROUND

In prior combination washer/dryer machines, the drying cycle is long and inefficient. Due to closed drying systems in these combination washer/dryer machines, additional time is required to dry clothes within the drum. This is unlike a conventional dryer that is vented to ambient. Here, conventional dryers include a blower that draws air into the drum for quickly drying the clothes within the dryer.

Also, in current combination washer/dryer machines, there is tendency to have localized high temperature areas in the drum. This leads to the contact with the clothes within the dryer or components within the cabinet of the combination washer/dryer machine. This high temperature concentration contact may cause undesirable imperfection to the clothes or to the components within the cabinet of the washer/dryer machine.

Accordingly, it is desirable to provide heated air in a uniform manner into the drum. This avoids localized high temperature areas. Thus, this would improve drying.

Generally, the combination washers/dryers utilize ducts to provide hot air through a small port or small local grille inside the tumbling cavity. Thus, the temperature are generally higher. This is less desirable on a combination washer/dryer where the majority of components are polymeric in nature.

Accordingly, it is an object of the disclosure to overcome the deficiencies of the prior combination washer/dryer machines. It is an object of the disclosure to provide a heating circuit that generates uniform drying air. Thus, this eliminates a localized drying area. The present disclosure provides a rigidly mounted heater and duct end cap. This eliminates or avoids high temperature flexible duct work or piping. Additionally, the present disclosure provides a larger area in the tumbling cylinder for the distribution of the heated air through the clothes.

SUMMARY

In accordance with the present disclosure, a combination washer/dryer machine comprises a cabinet, a tub positioned in the cabinet and a drum rotatably positioned in the tub. A heater is secured to the tub. The heater includes a duct to provide heated air from the heater to the tub which, in turn, is distributed into the drum. The duct is likewise secured to the tub. The tub includes at least one opening to receive heated air from the duct. The drum includes apertures in its end surface providing at least 50 $cm^2$ of open area of the area of the end surface. The heater includes a metal housing to be secured to the tub. The heater duct is also metal. The duct can be an independent separate part from the heater.

According to a second embodiment of the disclosure, a combination washer/dryer machine comprises a cabinet, a door enabling access into the cabinet, and controls for operating the washer/dryer machine. A washing circuit and drying circuit wash and dry the clothes within the drum. A heater is secured to the tub. The heater includes a duct to provide heated air from the heater to the tub. The heated air is distributed into the drum. The duct is likewise secured to the tub. The tub includes at least one opening to receive heated air from the duct. The drum includes apertures in its end surface providing at least 50 $cm^2$ of open area of the end surface. The heater includes a metal housing secured to the tub. The heater duct is also metal. The duct can be an independent separate part from the heater.

According to a third aspect of the disclosure, a combination washer/dryer machine tub and drum comprises a tub and a drum inside of the tub. A heater is secured to the tub. The heater includes a duct to provide heated air from the heater to the tub. The heated air is distributed into the drum. The duct is likewise secured to the tub. The tub includes at least one opening to receive heated air from the duct. The drum includes apertures in its end surface providing at least 50 $cm^2$ of open area of the end surface. The heater includes a metal housing to be secured to the tub. The heater duct is also metal. The duct can be an independent or separate part from the heater.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
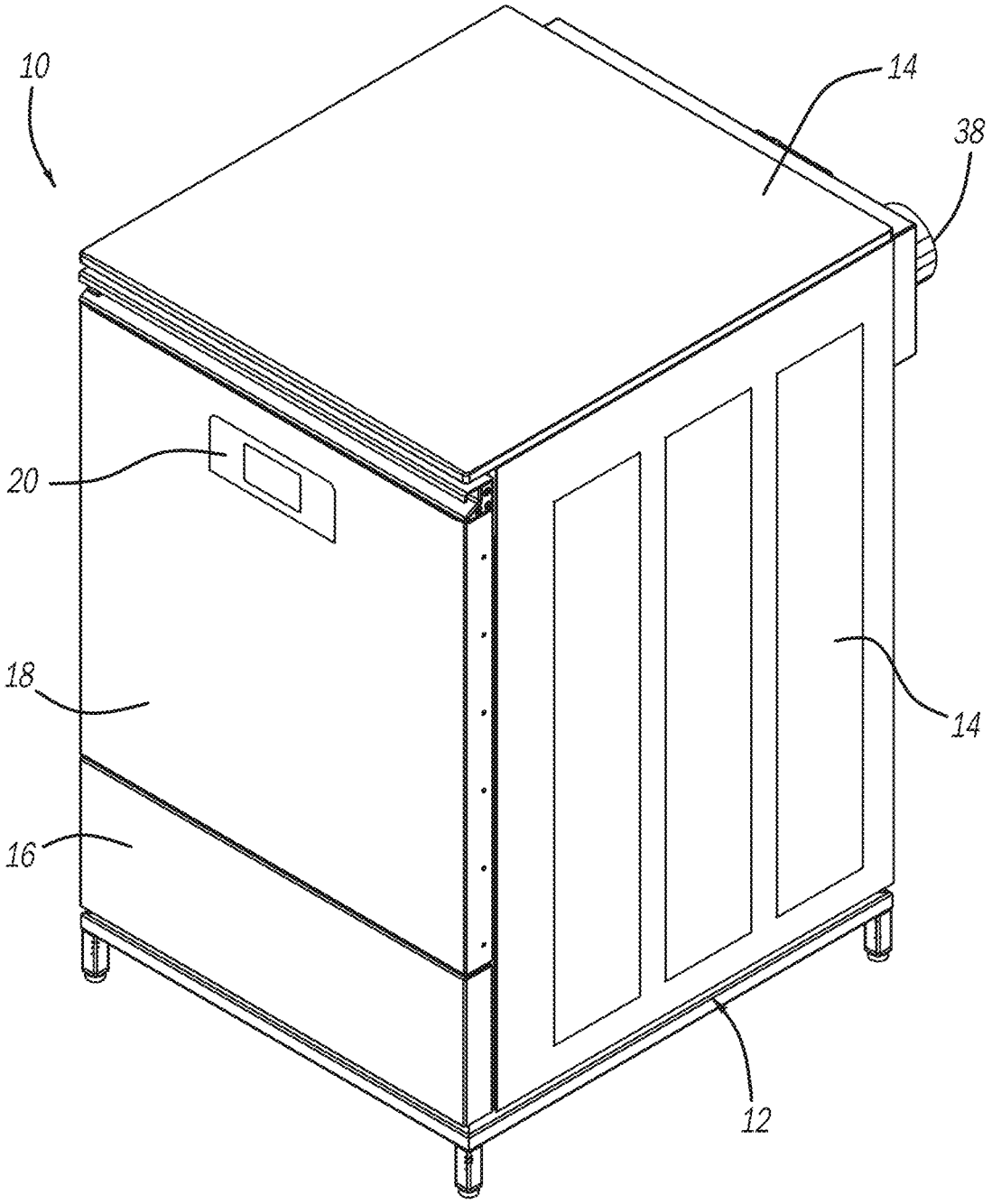
FIG. 1 is a perspective view of a combination washer/dryer machine in accordance with the disclosure.
Figure 2:
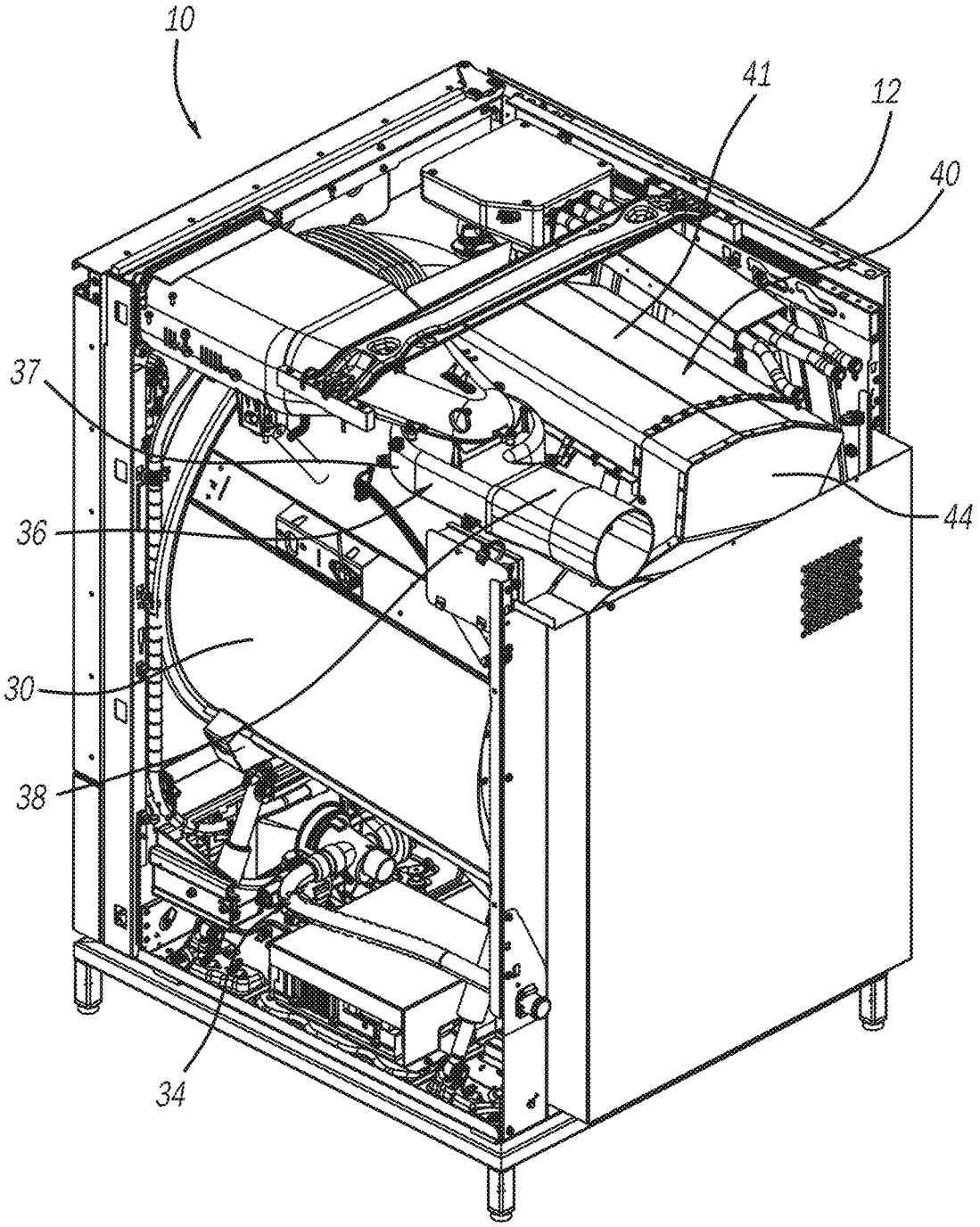
FIG. 2 is a rear breakaway perspective view of the combination washer/dryer machine of FIG. 1.
Figure 3:
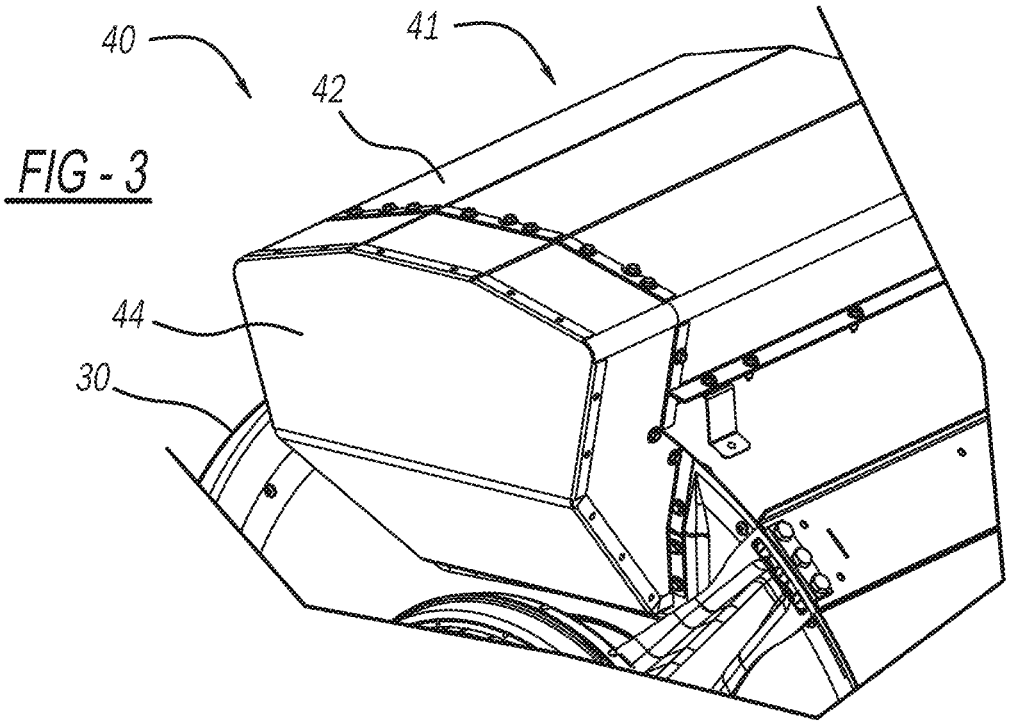
FIG. 3 is a breakaway perspective view of the washing machine of FIG. 1.
Figure 4:
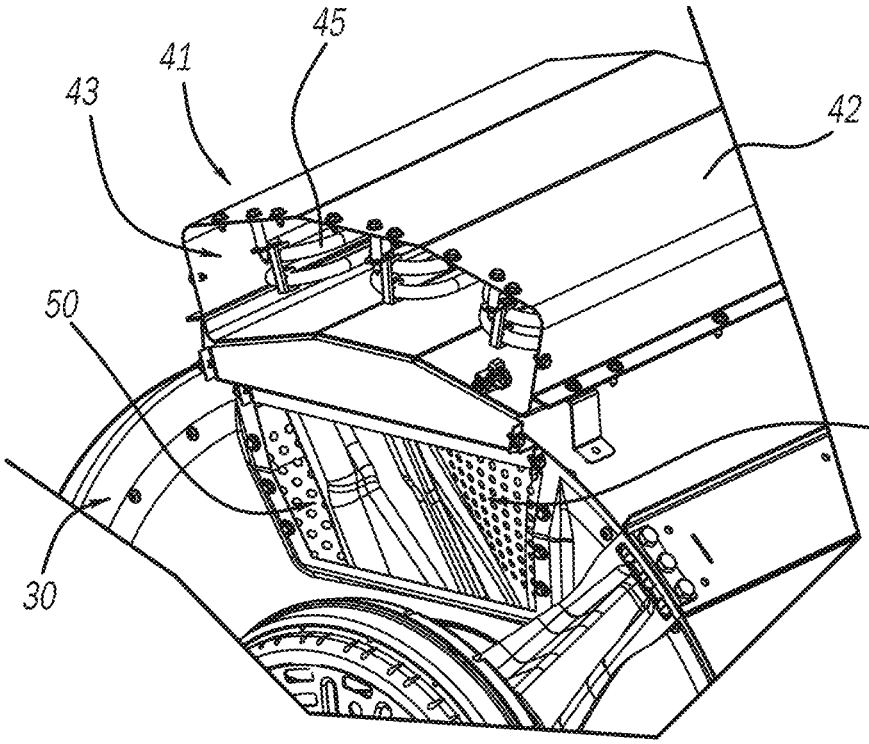
FIG. 4 is a view like FIG. 3 with duct work removed.
Figure 5:
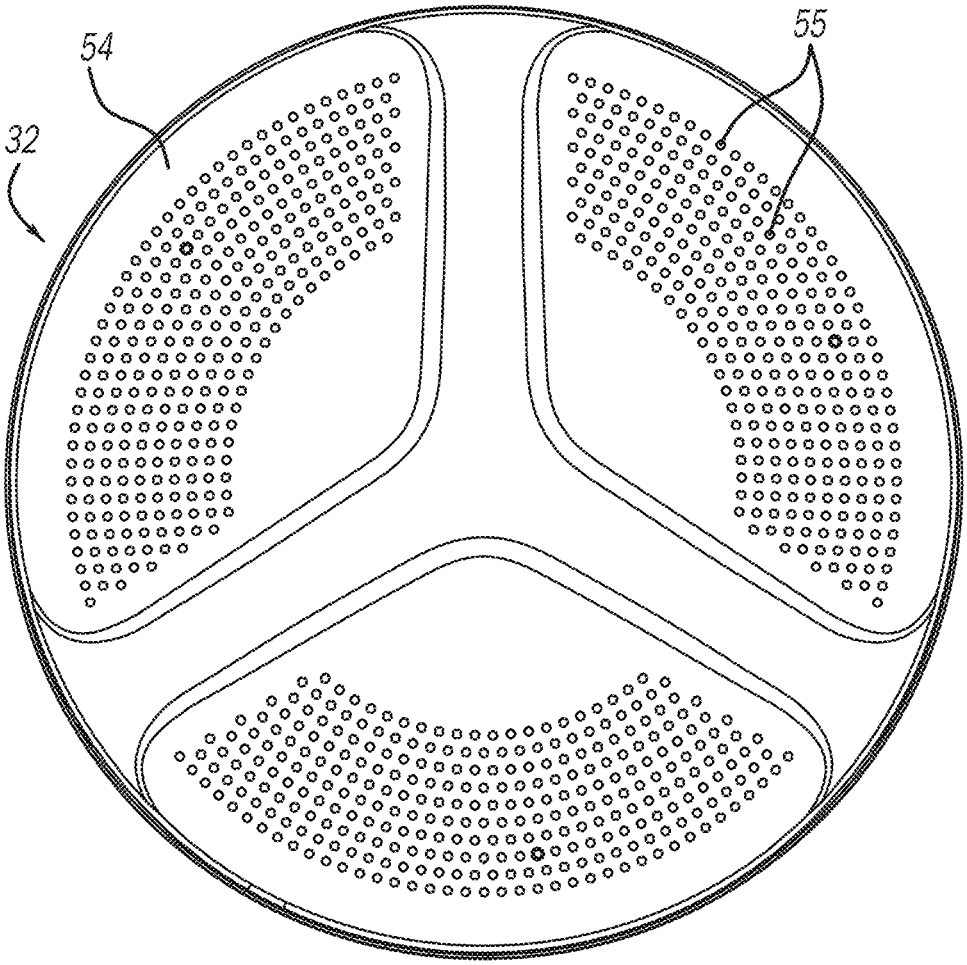
FIG. 5 is an elevation view of the drum rear surface.

Example embodiments will now be described more fully with reference to the accompanying drawings.

Turning to the figures, a combination washer/dryer machine is illustrated and designated with the reference numeral 10. The combination washer/dryer machine 10 includes a cabinet 12 with a plurality of panels 14. The front panel 16 includes a door 18 to enable access into the cabinet 12. A control panel 20 is located on the door 18 or front panel 16 of the cabinet 12. The combination washer/dryer machine 10 includes a tub 30 with a drum 32 rotatably positioned inside of the tub 30. A washing circuit 34 is illustrated coupled with the tub 30. Additionally, a vented drying air circuit 36 with a blower 37 is illustrated coupled with the tub 30. The blower 37 draws heated drying air though the drum 32 and then vents the drying air into the ambient surroundings through desired exhaust duct work 38 of the vented drying air circuit 36.

A heating circuit 40 includes a heater 41 that is positioned on the tub 30. The heater 41 includes a heating element housing 42 that is secured, via fasteners, to the tub 30. The heating element housing 42 includes an open end 43 and is generally a metal housing surrounding a calrod heating element 45 that is positioned within the heating element housing 42. The heating circuit 40 also includes a duct end cap 44 that is coupled with the tub 30. The duct end cap 44 enables the heated drying air to pass into the drum 32 through the tub 30. The duct end cap 44 has a desired design and is generally manufactured from a metallic material. Also, the duct end cap 44 is secured to the tub 32, via fasteners, to prohibit movement of the duct end cap 44 as well as the heating element housing 42. The rigid mounting of the heating element housing 42 and duct end cap 44 to the tub 30 enables the design to avoid high temperature flexible duct. Also, this eliminates movement of the heating element housing 42 and duct end cap 44 caused by vibration.

The tub 30 includes an opening 50 to enable passage of the heated drying air into the drum 32. The opening 50 may be a single large opening. Alternatively, a plurality of smaller openings may be present in a desired area to provide for structural integrity.

Additionally, the drum 32 includes an end portion 54. The end portion 54 has a plurality of apertures 55 to enable the heated drying air to pass into the drum 32. The apertures providing at least 50 $cm^2$ of open area in the end portion 54. For example, the illustrated design provides 180 $cm^2$ of open area. Accordingly, this enables adequate heated airflow to travel through the apertures 55 and into the tumbling clothes for drying purposes. Thus, the open area of the apertures 55 provides for the desired airflow into the drum 30 to dry the clothes within the drum 30.

In operation, drying is initiated. The control panel 20 initiates heating of the calrod heating element 45. As this occurs, the blower 37 in the vented drying air circuit 36 is initiated. This blower 37 draws the heated drying air from the heating circuit 40 through the opening 50 in the tub 30. After this, the heated drying air is drawn into the drum 32 via the apertures 55 in the end portion 54 of the drum 32. The drying air then exits the drum 32 and flows into the tub 30. The blower 37 then draws the drying air from the tub 30 and ultimately vents the drying air out of the cabinet 12 via the exhaust duct work 38.

Thus, the heated air is drawn through the drum 32 to efficiently dry the clothes within the drum 32. The drying time is thus substantially reduced.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A combination washer/dryer machine, comprising:

a cabinet;

a tub positioned in the cabinet;

a drum rotatably positioned in the tub;

a vented drying air circuit coupled with the tub, the vented drying air circuit including a blower for drawing drying air through the drum and exhaust duct work for venting the drying air from the cabinet;

a heater secured to the tub, the heater including a heating element positioned within a heating element housing for heating the drying air; and a duct end cap coupled with the tub for supplying the heated drying air from the heater to the tub, wherein the heating element housing and the duct end cap form a heating circuit that is separate from the vented drying air circuit where the heated drying air from the heating circuit passes through the tub and the drum before entering the exhaust duct work of the vented drying air circuit.

2. The combination washer/dryer machine of claim 1, wherein both the duct end cap and the heating element housing are rigidly mounted to the tub.

3. The combination washer/dryer machine of claim 1, wherein the duct end ca extends over and covers an open end of the heating element housing and at least one opening of the tub.

4. The combination washer/dryer machine of claim 1, wherein the drum includes apertures in an end portion of the drum that collectively provide at least 50 $cm^2$ of open area in the end portion of the drum.

5. The combination washer/dryer machine of claim 1, wherein the heating element housing is metal.

6. The combination washer/dryer machine of claim 1, wherein the duct end cap is metal.

7. The combination washer/dryer machine of claim 6, wherein the duct end cap is an independent part separate from the heating element housing.

8. A combination washer/dryer machine, comprising:

a cabinet;

a door enabling access into the cabinet;

a washing circuit;

a tub positioned in the cabinet;

a drum rotatably positioned in the tub;

a vented d in air circuit coupled with the tub the vented dr in air circuit including a blower for drawing drying air through the drum and exhaust duct work for venting the drying air from the cabinet; and a heating circuit that is separate from the vented drying air circuit, the heating circuit including a heater secured to the tub and a duct end cap coupled with the tub for directing heated drying air from the heater to the tub.

9. The combination washer/dryer machine of claim 8 wherein both the duct end cap and the heater are rigidly mounted to the tub.

10. The combination washer/dryer machine of claim 8, wherein the tub includes at least one opening to receive heated air from the heater and the duct end cap extends over and covers both the at least one opening in the tub and an open end of the heater.

11. The combination washer/dryer machine of claim 8, wherein the drum includes apertures in an end portion of the drum that collectively provide at least 50 $cm^2$ of open area in the end portion of the drum.

12. The combination washer/dryer machine of claim 8, wherein the heater includes a metal heating element housing that is secured to the tub.

13. The combination washer/dryer machine of claim 8, wherein the duct end cap is metal.

14. The combination washer/dryer machine of claim 13, wherein the duct end cap is an independent part separate from the heater.

15. A combination washer/dryer machined, comprising:

a tub;

a drum rotatably positioned in the tub;

a vented drying air circuit coupled with the tub, the vented drying air circuit including a blower for drawing d in air through the drum and exhaust duct work for venting the drying air;

a heater that is separate from the vented drying air circuit and secured to the tub outside of the vented drying air circuit, the heater including a heating element positioned within a heating element housing for heating the drying air; and a duct end cap coupled with the tub for supplying the heated drying air to the tub, wherein the heating element housing and the duct end cap form a heating circuit that is separate from the vented drying air circuit.

16. The combination washer/dryer machine of claim 15, wherein both the duct end cap and the heating element housing are rigidly mounted to the tub.

17. The combination washer/dryer machine of claim 15, wherein the tub includes at least one opening to receive heated drying air from the heater and the duct end cap extends over and covers both the at least one opening in the tub and an open end of the heating element housing.

18. The combination washer/dryer machine of claim 15, wherein the drum includes apertures in an end portion of the drum that collectively provide at least 50 $cm^2$ of open area in the end portion of the drum.

19. The combination washer/dryer machine drum and tub combination of claim 15, wherein the heating element housing is metal.

20. The combination washer/dryer machine drum and tub combination of claim 19, wherein the duct end cap is metal.

* * * * *